United States Patent [19]

Brown

[11] 4,267,418

[45] May 12, 1981

[54] ELECTRIC SWITCH DEVICE

[76] Inventor: Ronald O. Brown, 333 Ozark Dr., Bolingbrook, Ill. 60439

[21] Appl. No.: 12,909

[22] Filed: Feb. 16, 1979

Related U.S. Application Data

[63] Continuation-in-part of Ser. No. 839,192, Oct. 4, 1977, abandoned.

[51] Int. Cl.[3] ..... H01H 1/38

[52] U.S. Cl. ..... 200/163; 200/288; 200/275; 200/243; 200/241

[58] Field of Search ..... 200/16 A, 16 E, 16 B, 200/163, 243, 275, 241, 252, 258, 279, 288

[56] References Cited

U.S. PATENT DOCUMENTS

| | | | |
|---|---|---|---|
| 789,457 | 5/1905 | Sargent | 200/16 E |
| 1,125,948 | 1/1915 | Boyle | 200/159 R |
| 1,158,955 | 11/1915 | Apple et al. | 200/163 |
| 1,935,509 | 11/1933 | Leeah et al. | 200/163 |
| 2,421,267 | 5/1947 | Huber | 200/288 |
| 2,659,791 | 11/1953 | Dickinson | 200/331 |
| 2,698,369 | 12/1954 | Daily et al. | 200/163 |
| 2,853,627 | 9/1958 | Karl | 200/16 B |
| 2,891,134 | 6/1959 | Ramrath | 200/288 |
| 3,129,311 | 4/1964 | Bergstrasser | 200/288 |
| 3,315,189 | 4/1967 | Heft et al. | 335/21 |
| 3,617,673 | 11/1971 | Weston | 200/275 |
| 3,703,621 | 11/1972 | Viola et al. | 200/16 E |
| 3,848,101 | 11/1974 | Eberhard et al. | 200/288 |

*Primary Examiner*—John W. Shepperd

*Attorney, Agent, or Firm*—Neuman, Williams, Anderson & Olson

[57] ABSTRACT

An electric switch device is provided having angled contact surfaces. First and second contact members are supported for movement of the second member relative to the first between open and closed positions. Planar contact surfaces of the members are in flush engagement in the closed position with such surfaces being at an acute angle, preferably between five and ten degrees, relative to the direction of movement. The contact members are substantially rigid and are so guided that the contact surfaces are at the same acute angle at impact. Preferably, the second contact member has another contact surface engageable with a contact surface of another contact member with such contact surfaces being at the same acute angle and cooperating in the same manner. The angle is such as to prevent contact bounce and prevent separation under high surge currents providing low contact resistance and minimizing operating forces.

2 Claims, 3 Drawing Figures

ELECTRIC SWITCH DEVICE

This application is a continuation-in-part of my copending application, Ser. No. 839,192, filed Oct. 4, 1977 now abandoned.

This invention relates to an electric switch device and more particularly to an electric switch device which is relatively small in size and weight and relatively simple and inexpensive in operation and construction while efficiently and reliably handling large operating and surge currents.

BACKGROUND OF THE INVENTION

Switch devices are used for various purposes, as contactors circuit breakers, relays and the like, and representative types are disclosed in the Sargent U.S. Pat. No. 789,457, The Ansingh U.S. Pat. No. 1,623,954, the Pandapas U.S. Pat. No. 2,866,046, the Burch U.S. Pat. No. 2,924,685, the Skay U.S. Pat. No. 3,054,871, the McFarland U.S. Pat. No. 3,619,533, the Vrola, et al. U.S. Pat. No. 3,703,621 and the Eberhard, et al. U.S. Pat. No. 3,848,101. In such switch devices, problems are oftentimes encountered in connection with a bouncing action produced when one contact is moved into an impact engagement with another, such an action being due in part to the resiliency of the contacts or the resiliency of the contact support. In many cases, a relative tilting action occurs when contact surfaces are brought together and the resiliency of the contacts or the contact supports have contributed to the relative tilting action which reduces areas of interengagement and produces high concentration of currents in small areas. High current concentrations are also a problem when one or both of a pair of engaging contact surfaces are rounded or pointed. There is in addition a problem in connection with contacts being blown apart when there are high surge currents, the problem being due to the fact that very high repulsion forces are developed by the magnetic fields produced from currents flowing in closely spaced parallel relation in two engaging contact members.

There have been attempts to solve contact bounce and other problems. For example, the Huber U.S. Pat. No. 2,421,267 shows a switch using springs with different natural periods of vibration and damping means as disclosed in the Bergstraesser U.S. Pat. No. 3,129,131 and Ramrath U.S. Pat. No. 2,891,134. In addition, there have been special purpose instructions such as disclosed in the Weston U.S. Pat. No. 3,617,671 and the Karl U.S. Pat. No. 2,853,627. The Karl Patent discloses an automotive safety switch having conical contacts.

Such disclosures do not solve the basic causes of problems and, as a result, prior art devices have been relatively heavy in construction, using large contacts and using actuating mechanisms capable of applying large forces to obtain acceptable current handling capability, to avoid contact bounce and to allow handling of surge currents.

SUMMARY OF THE INVENTION

This invention was evolved with the general object of overcoming the disadvantage of prior art constructions and inexpensive in operation and construction and of small size and weight while being effective to efficiently and reliably handle large operating and surge currents.

In accordance with this invention, first and second contact members are supported for movement of the second member relative to the first between an open position and a closed position in which planar contact surfaces of the members are in flush engagement at an acute angle to the direction of movement. The contact members are substantially rigid and are so supported and guided as to maintain both surfaces at the same acute angle to the direction of movement at the time of impact.

Very important advantages result from the combination of the use of an angle within a limited range, the use of rigid contact members and the support arrangement as described. In particular, contact bounce is effectively obviated because of the fact that contact deformation is primarily in a direction transverse to the direction of the applied movement and also due to the absorption of energy from the frictional interengagement of the contact surfaces. Such frictional absorption of energy is greatly increased because of the angle which causes a relative sliding action and also because of a large area of interengagement between the contact surfaces which results partly because of the rapidity of the contact members. Another advantage is greatly reduced contact resistance, resulting from the increased area of interengagement of contact surfaces and also from the attainment of intimate contact of the two contact surfaces which is obtained as a result of relative sliding movement thereof and other conditions as hereinafter discussed.

A further advantage is that very large surge currents can be handled. Repulsive forces developed magnetically from parallel currents flowing in the two contact members are not applied in direct opposition to the applied holding forces and due to the relatively small angle, only a small component of such forces is applied. As a result, a switch device is provided which can efficiently and reliably handle large operating and surge currents while being quite small in size and weight and inexpensive in construction.

The angle is important, being small enough to prevent separation of the contact surfaces from reverse direction rebound forces applied between the contact members at impact and being large enough to insure separation of the contact surfaces in response to application of the separating force applied from the actuating means. In my prior application, I set forth that the angle should be between 3 and 30 degrees which remains true, but I have subsequently determined, that optimum results with respect to elimination of contact bounce are obtained if the angle is kept within a more limited range and I have also found that vastly superior contact surfaces are formed from an action as disclosed in my prior application, when the angle is kept within a more limited range. In particular, the angle should be on the order of from 5 to 10 degrees and preferably it is between 5 and 8 degrees.

Below 5 degrees, there can be some tendency toward contact sticking and while the advantages are lessened as the angle is increased above 5 degrees, an angle of 7 or 8 degrees can oftentimes be used and still obtain very important advantages.

In my prior application, I disclosed that the contact material is "peened" to provide very smooth planar surfaces with which intimate contact and a very low contact resistance is obtained. I have since performed experiments which demonstrate the formation of such surfaces and I do not known that "peened" is the most accurate description. The action may be more accurately described as a "burnishing" action and in any case a very smooth surface-forming action is performed by engagement of contacts under the proper conditions. It is necessary that the conact surfaces be rigid and that they be at the same angle to the direction of movement at impact. As a practical matter, it is essential that the surfaces be planar because it would not be possible to initially form conical or frusto-conical surfaces to the required accuracy such as to produce the very smooth surface-forming action. It is additionally important that the surfaces be of a ductile metal.

With further regard to the very smooth surface-forming action, it is noted that a number of repeated contact closings and openings are necessary for the action to take place. No matter how carefully and accurately two surfaces are initially prepared, they will initially engage only at three points of very small areas and in the absence of a combination of special conditions, such very small areas will not increase substantially in size with repeated operations.

If, however, the surfaces are carefully prepared so as to be as accurately planar as is possible and if they are rigid, at the same acute angle to the direction of movement at impact and if a ductile material, a few closings will build up the area of the interengaging surface portions very rapidly. In the initial closing, the effective pressure between the very limited areas of engagement may be extremely high, on the order of tens of millions of pounds per square inch, compressing and expanding the high spots at which the initial engagements take place. As a result, the interengaging areas increase rapidly in size and in only 5 to 10 operations, up to 90% or more of the obtainable increase may be obtained. It is noted that once the action is initiated, the increase in area will greatly decrease the impact pressure, thereby greatly reducing the rate at which the area is built up. The area can be built up to a substantial size only by maintaining the proper conditions.

In connection with the very smooth surface-forming action and the large areas for intimate contact obtained therefrom, it is noted that when a movable contact is moved toward a fixed contact by a solenoid or other actuating means, the movable contact will have a certain velocity and a certain kinetic energy which must be dissipated. When the engaging surfaces are at a very acute angle such as 5% and when the areas are large and very smooth, there can be a very small relative sliding action in which both contacts are compressed to dissipate the kinetic energy internally without producing forces which would force the contacts apart in a rebound action. At the same time, there is no interstitial locking engagement between the contact surfaces which might severely inhibit separation, and the contacts can be readily separated when desired. The formation of the large and very smooth surface portions is thus very important in insuring against contact bounce and allowing separation of contacts as well as in allowing the switch to efficiently handle large operating and surge currents.

The very smooth surface areas additionally provide a very useful criteria for determining whether the optimum action is being obtained. By operating any given switch several times, a quick determination can be made as to whether the areas are being developed and thus whether the angles, support and other conditions are proper.

In my prior application, I have as an example the provision of contact members having surfaces one-fourth inch wide by one inch large, in the direction of travel, to obtain a normal operating current capacity on the order of 100 amperes. That disclosure is extremely conservative. Switches constructed in accordance with the invention are capable of handling surge current on the order of several hundreds of times greater than the normal operating currents assigned to switches having contacts of the same overall size as those constructed in accordance with the invention.

The support means for the contact members preferably operates during contact closing to limit relative movement of the contact members in a direction transverse to the direction of movement to maintain the contact surfaces in pressure engagement during and after impact thereof. In a preferred arrangement, the movable contact member operates as a bridging contact and has two contact surfaces engageable with contact surfaces of two fixed contact members thus providing two pairs of interengaging contact surfaces with the contact surfaces of each pair being at the same acute angle to the direction of movement. Relative transverse movement of each pair of contacting surfaces is thus limited by engagement of the other pair of contact surfaces.

This invention contemplates other objects, features and advantages which will become more fully apparent from the following detailed description taken in conjunction with the accompanying drawings.

DESCRIPTION OF A PREFERRED EMBODIMENT

Figure 1:
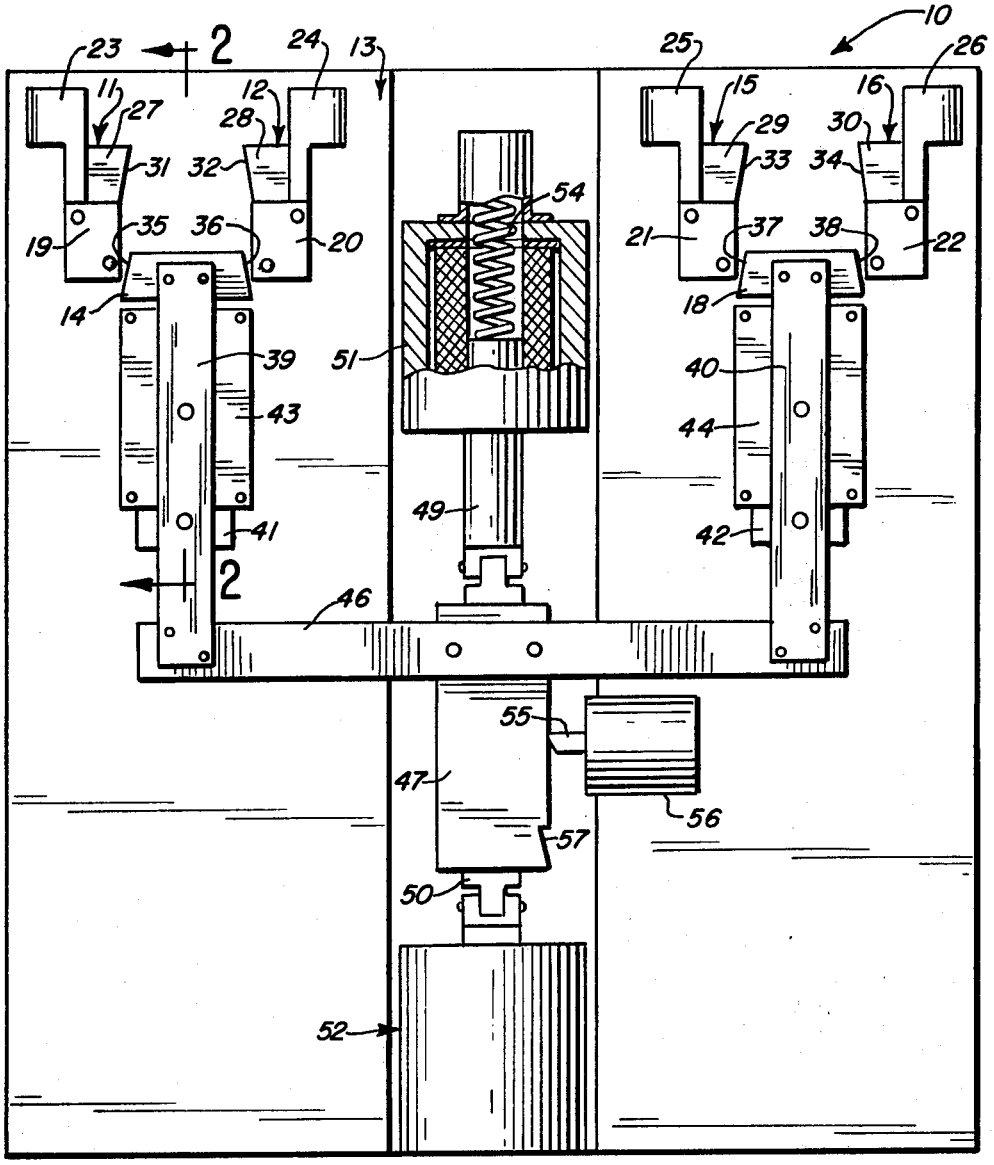
FIG. 1 is a top plan view of a switch device constructed in accordance with the invention.
Figure 2:
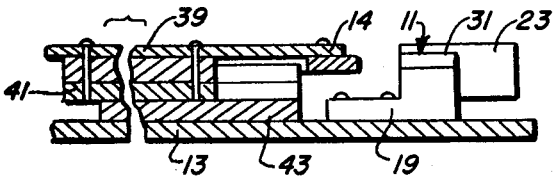
FIG. 2 is a sectional view taken substantially along line II—II of FIG. 1.
Figure 3:
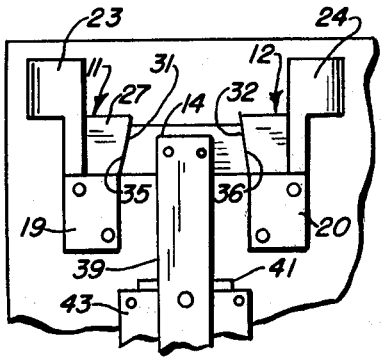
FIG. 3 is a top plan view of a portion of the switch device, illustrating contact members in an engaged or closed position.

Reference numeral 10 generally designates a switch device constructed in accordance with the principles of this invention, in the form of an electrical contactor. The illustrated device 10 includes a pair of contact members 11 and 12 which are fixedly supported from a base 13 and are arranged to be engaged and electrically interconnected by a movable contact 14. A second pair of contact members 15 and 16 are also supported from the base 13 and are arranged to be engaged and electrically interconnected by a movable contact member 18.

The contact members 11, 12, 15 and 16 are supported from the base 13 by supports 19–22 of insulating material and have lug portions 23–26 for connection to wires or cables. The contact members 11, 12, 15 and 16 also have contact portions 27–30 which, as illustrated, are in the form of flat plate portions which have planar contact surfaces 31–34 of rectangular form. The movable contact members 14 and 18 are in the form of flat slugs or plates of substantial thickness, the member 14 having planar contact surfaces 35 and 36 engageable with the surfaces 31 and 32 of members 11 and 12 and the movable contact member 18 having planar contact surfaces 37 and 38 engageable with surfaces 33 and 34 of contact members 15 and 16. Each of the fixed contact surfaces 31–34 is at an acute angle to the direction of movement of the associated movable contact member and each of the movable contact surfaces 35–38 is at the same acute angle to the direction of movement thereof. The movable contact members 14 and 18 are of trapezoidal form with the contact surfaces of each member being aligned in a direction transverse to the direction of movement.

The movable contact members 14 and 18 are secured to the ends of support bars 39 and 40 of insulating material which are secured to members 41 and 42 movable in guideways defined by a pair of members 43 and 44 secured to the base 13. The opposite ends of the bars 39 and 40 are secured to the ends of a yoke member 46 having a central portion secured to a bar 47 which is parallel to the bars 39 and 40 and which has opposite ends connected from reverse direction rebound forces developed from the resiliency of the contact members at impact and is large enough to insure separation of the contact surfaces in response to application of the separating force applied to the contact members, as from the solenoid 52 or spring 54, for example.

It is important that the contact members be substantially rigid to avoid any tilting action of the contact surfaces and to insure flush engagement with a large areas of interengagement. It is also important in this connection that the interengaging contact surfaces be at exactly the same angle to the direction of movement as impact.

Both the fixed and movable contact member may be of copper which is plated with fine silver to provide decreased contact resistance. In any case, the contact members should preferably be of a metal having ductility such that after a few operations of the device, a very smooth surface-forming action will take place over large areas so as to obtain very smooth surfaces with which intimate contact and a very low contact resistance is obtained.

By way of example, the contact members 14 and 18 may be one-fourth inch in thickness and one inch long in the direction of travel, to provide contact surfaces one inch long by one-fourth inch wide and to provide a normal operating current capacity, according to existing standards, of on the order of 100 amperes. If higher current-carrying capacity, as determined by existing standards, is desired, additional switch members may be provided having the same dimensions, in a stacked or "wafer" arrangement. As aforementioned, existing standards as applied to switches of this invention result in obtaining extremely high reserve and surge current capacity and it is quite possible that switches constructed in accordance with the invention will ultimately be approved for ratings which are much higher than those dictated by the size of the switch.

As another example, I constructed a switch similar to that described above but with each of the contact surfaces being 0.75 inches by 0.3125 inches and with an angle of 5 degrees. After a few operations, very smooth surface areas were formed over well over half of the total areas of the contacts and after 7000 operations, the very smooth surface area was built up to 90% of the total area. With that switch, I successfully closed into a 17,000 ampere load eight times with no problems. The switch was also tested for contact bounce using an oscilloscope and the trace showed that no bounce was produced.

I have also found that a 5 degree angle is optimum under the conditions set forth and with a 5 degree angle it is not necessary to use springs to hold the contacts together even with large currents although a light spring pressure is probably desirable as a precautioning measure especially if the device is to be used in conditions where there are shocks and vibrations.

The contact arrangement of this invention permits the use of relatively high impact velocities without rebound in a manner such as to obtain a very high degree of intimate contact between large surface areas and to obtain correspondingly low contact resistances. At the same time, the force required to keep the contact surfaces in engagement is minimized. By way of example, the relative contact velocity in a device constructed as illustrated, may be on the order of 120 inches per second at impact and higher velocities may be used.

It is noted that the solenoid 51 may be maintained in an energized condition to keep the movable contact members 14 and 18 in the closed positions and they may be moved back to the open position by de-energizing the solenoid 51 and energizing the solenoid 52. Alternatively or in addition, a compression spring 54 is engaged with the armature 49 of solenoid 51 to urge the assembly toward the contact open position and a latch bar 55, operated by a solenoid 56, is engaged in a notch 57 of the bar 47 in the closed position, to hold the contact members in the closed positions and to permit de-energization of the solenoid 51. Then when movement to the open position is desired, the solenoid 56 may be energized.

It will be understood that modifications and variations may be effected without departing from the spirit and scope of the novel concepts of this invention.

I claim:

1. In an electrical switch device for handling large operating and surge currents, a first contact member defining a first planar contact surface, a second contact member defining a second planar contact surface, support means supporting said contact members for movement of said second contact member relative to said first contact member between an open position spaced therefrom and a closed position in which said first and second planar contact surfaces are in flush engagement in a plane at an acute angle to the direction of said relative movement, and actuating means for moving said second contact member between said open and closed positions, said contact surfaces being of a ductile metal and at least substantial portions thereof being very smooth and being in intimate contact in said closed position with said portions being such as produced by a very smooth surface-forming action on said contact surfaces during repeated movements from said open position to said closed position, said first and second contact members being substantially rigid, a third contact member supported by said support means in fixed relation to said first contact member, and cooperating with said second contact member to define third and fourth planar contact surfaces spaced apart in said open position of said contact member and in flush engagement with said closed position thereof, said third and fourth planar surfaces being at an acute angle to said direction of relative movement which is of the same magnitude as that of said first and second contact surfaces but in an opposite direction, equal and opposite transverse forces being applied to said contact member from impact of said second and fourth contact surfaces with said first and third contact surfaces so as to limit transverse movement of said second contact member, said support means and the relationship of said contact surfaces being further of such that said first and second planar surfaces are maintained at the same acute angle to said direction of movement at impact between said first and second planar surfaces to facilitate obtaining said very smooth surface-forming action for maintaining and enlarging the areas of said very smooth contact surface portions, said actuating means being operative to effect engagement of said first and second contact surfaces at a certain impact velocity and to apply a certain separating force between said contact members along said direction of movement, and said acute angle being on the order from five to eight degrees and being small enough to prevent separation of said contact surfaces from reverse direction rebound forces applied between said contact members at impact while being large enough to insure separation of said contact surfaces in response to application of said separate force.

2. In a device as defined in claim 1, said support means being operative to allow a limited transverse movement of said second contact member to insure a wedging action through the cooperation of said contact surfaces while restraining said second contact member against any substantial twisting movement about an axis parallel to said direction of relative movement.

* * * * *